US010813173B2

(12) United States Patent
Ouyang et al.

(10) Patent No.: US 10,813,173 B2
(45) Date of Patent: Oct. 20, 2020

(54) DRIVING ASSEMBLY IN ELECTRONIC CIGARETTE HAVING STABLE TOTAL PARTICULATE MATTER (TPM) VALUE OUTPUT

(71) Applicant: Shenzhen First Union Technology Co., Ltd., Shenzhen, Guangdong Province (CN)

(72) Inventors: Zhi Ouyang, Shenzhen (CN); Qiaoyun Zhong, Shenzhen (CN); Yonghai Li, Shenzhen (CN); Zhongli Xu, Shenzhen (CN)

(73) Assignee: Shenzhen First Union Technology Co., Ltd., Shenzhen, Guangdong (CN)

( * ) Notice: Subject to any disclaimer, the term of this patent is extended or adjusted under 35 U.S.C. 154(b) by 217 days.

(21) Appl. No.: 15/844,467

(22) Filed: Dec. 15, 2017

(65) Prior Publication Data

US 2018/0176990 A1 Jun. 21, 2018

(30) Foreign Application Priority Data

Dec. 15, 2016 (CN) ..... 2016 1 1161627

(51) Int. Cl.
*A24F 11/00* (2006.01)
*A24F 47/00* (2020.01)
*H05B 1/02* (2006.01)

(52) U.S. Cl.
CPC ..... *H05B 1/0297* (2013.01); *A24F 47/008* (2013.01)

(58) Field of Classification Search
CPC ..... A24F 47/008; A24F 47/002; A24F 40/50; A24F 40/53; A61M 11/042; A61M 15/06
USPC ..... 131/328
See application file for complete search history.

(56) References Cited

U.S. PATENT DOCUMENTS

| | | | | |
|---|---|---|---|---|
| 10,398,176 | B2 * | 9/2019 | Hon | A61M 15/06 |
| 2014/0251324 | A1 * | 9/2014 | Xiang | A24F 47/008 128/202.21 |
| 2015/0040930 | A1 | 2/2015 | Robinson et al. | |
| 2016/0213066 | A1 | 7/2016 | Zitzke et al. | |
| 2016/0242466 | A1 * | 8/2016 | Lord | G06F 1/3296 |
| 2018/0140014 | A1 * | 5/2018 | Yu | H05B 3/145 |

(Continued)

FOREIGN PATENT DOCUMENTS

| | | | |
|---|---|---|---|
| CN | 104839896 | A | 8/2015 |
| CN | 204540815 | U | 8/2015 |

(Continued)

*Primary Examiner* — Abdullah A Riyami
*Assistant Examiner* — Thang H Nguyen
(74) *Attorney, Agent, or Firm* — PROI Intellectual Property US; Klaus Michael Schmid

(57) ABSTRACT

The present disclosure provides a driving method, a driving assembly, and an electronic cigarette having the same. The driving method includes: acquiring an output voltage of a power supply of the electronic cigarette; calculating a duty ratio meeting a preset power using the detected output voltage and an effective resistance of a heating assembly; and driving a current circuit of the heating assembly of the electronic cigarette to switch on or switch off according to the duty ratio, so that the heating assembly operates under the preset power. According to the present disclosure, the cost of the electronic cigarette can be lowered, a relatively stable TPM (Total Particulate Matter) value can be output, and the size of the electronic cigarette can be reduced.

10 Claims, 4 Drawing Sheets

(56) References Cited

U.S. PATENT DOCUMENTS

| | | | | |
|---|---|---|---|---|
| 2019/0230982 | A1* | 8/2019 | Inagaki | A24F 47/002 |
| 2020/0108409 | A1* | 4/2020 | Oda | A24F 47/008 |

FOREIGN PATENT DOCUMENTS

| | | | |
|---|---|---|---|
| CN | 204905326 | U | 12/2015 |
| CN | 204969459 | U | 1/2016 |
| CN | 105686087 | A | 6/2016 |
| CN | 105764366 | A | 7/2016 |
| GB | 2 519 101 | A | 4/2015 |
| GB | 2 533 651 | A | 6/2016 |
| WO | 2015069914 | A1 | 5/2015 |
| WO | 2016176800 | A1 | 11/2016 |
| WO | 2018069995 | A1 | 4/2018 |

* cited by examiner

DRIVING ASSEMBLY IN ELECTRONIC CIGARETTE HAVING STABLE TOTAL PARTICULATE MATTER (TPM) VALUE OUTPUT

CROSS REFERENCE TO RELATED APPLICATIONS

The present application claims priority to Chinese Patent Application CN 2016 111 616 27.0 filed on Dec. 15, 2016.

TECHNICAL FIELD

The present disclosure relates to the field of smoking sets, and particularly, to a driving method, a driving assembly, and an electronic cigarette having the same.

BACKGROUND

With the increasing maturity of present electronic cigarette markets, traditional electronic cigarettes have been unable to meet the requirements of consumers, because these traditional electronic cigarettes have high cost and large size. The electronic cigarette is a system powered by a battery cell. When a heating assembly in the electronic cigarette operates, an output voltage of the battery cell changes with factors such as quantity of electricity, discharge ability, load condition and discharge time, which results in that an actual heating power of the heating assembly changes continuously; therefore, current electronic cigarettes cannot ensure a stable Total Particulate Matter (TPM) value output.

SUMMARY

The main technical problem to be solved by the present disclosure is providing a driving method, a driving assembly, and an electronic cigarette having the same, with which the cost of the electronic cigarette can be lowered, a relatively stable TPM value can be output and the size of the electronic cigarette can be reduced.

In order to solve the above technical problem, the present disclosure employs a technical scheme as follows. A driving method for an electronic cigarette is provided, the electronic cigarette having a power supply and a heating assembly, the method including: acquiring an output voltage of the power supply; calculating a duty ratio meeting a preset power using the detected output voltage and an effective resistance of the heating assembly; and driving, according to the duty ratio, a current circuit of the heating assembly of the electronic cigarette to switch on or switch off, so that the heating assembly operates under the preset power.

The step of calculating the duty ratio meeting the preset power using the detected output voltage and the effective resistance of the heating assembly includes: obtaining the duty ratio using the following formula:

$$\text{Duty} = \frac{P \times R}{U \times U},$$

where Duty denotes the duty ratio, P denotes the preset power, R denotes the effective resistance, and U denotes the detected output voltage; collecting the output voltage and the effective resistance of the heating assembly within one cycle, and adjusting, according to the calculated duty ratio, the switch-on time of the current circuit of the heating assembly within one cycle, so that an average power within one cycle is equal to the preset power.

The step of collecting the effective resistance of the heating assembly within one cycle specifically includes: collecting a voltage value of a standard resistor in series connection with the heating assembly, and calculating the effective resistance of the heating assembly according to a proportional relationship of voltage division and resistance between the standard resistor and the heating assembly.

In order to solve the above technical problem, the present disclosure employs a technical scheme as follow. A driving assembly for an electronic cigarette is provided, the electronic cigarette including a heating assembly, the driving assembly being configured for driving the heating assembly to heat liquid or tobacco so as to generate an aerosol; the driving assembly includes: a master control circuit, the master control circuit including an analog-digital converter, the analog-digital converter including an input end coupled to a power supply; and an output power control circuit, the output power control circuit including an input end coupled to the power supply, an output end coupled to the heating assembly, and a control end coupled to the master control circuit; wherein the master control circuit is configured for detecting an output voltage of the power supply, calculating a duty ratio meeting a preset power using the detected output voltage and an effective resistance of the heating assembly, and outputting the duty ratio to the output power control circuit; and the output power control circuit is configured for driving, according to the duty ratio, a current circuit of the heating assembly to switch on or switch off, so that the heating assembly operates under the preset power.

Herein, the driving assembly further includes a resistance detection circuit, the resistance detection circuit including a control end, an input end and an output end, the control end being coupled to the master control circuit, the input end being coupled to the power supply, the output end being coupled to a standard resistor and the heating assembly in sequence; the master control circuit further includes a voltage detection end, which is coupled to the standard resistor; wherein the master control circuit is configured for controlling the output power control circuit to switch off, and meanwhile controlling the resistance detection circuit to switch on a current path between the power supply and the standard resistor, so as to detect the voltage of the standard resistor through the voltage detection end and to calculate the effective resistance of the heating assembly according to a proportional relationship of voltage division and resistance between the standard resistor and the heating assembly.

Herein, the driving assembly further includes a smoking triggering switch circuit coupled to the master control circuit, wherein when the smoking triggering switch circuit is activated, calculation and output actions of the duty ratio are triggered.

Herein, the smoking triggering switch circuit includes a button or airflow sensor.

Herein, the frequency of the calculation and output actions of the duty ratio is consistent with an output pulse generated by the output power control circuit.

Herein, the output power control circuit is a PWM (Pulse Width Modulation) control circuit, a BUCK-BOOST circuit, a BUCK circuit or a BOOST circuit.

In order to solve the above technical problem, the present disclosure employs another technical scheme as follows. An electronic cigarette is provided, the electronic cigarette having a power supply and a heating assembly and the electronic cigarette including: a master control circuit, the master control circuit including an analog-digital converter, the analog-digital converter including an input end coupled to a power supply; and an output power control circuit, the output power control circuit including an input end coupled to the power supply, an output end coupled to the heating assembly, and a control end coupled to the master control circuit; wherein the master control circuit is configured for detecting an output voltage of the power supply, calculating a duty ratio meeting a preset power using the detected output voltage and an effective resistance of the heating assembly, and outputting the duty ratio to the output power control circuit; and the output power control circuit is configured for driving, according to the duty ratio, a current circuit of the heating assembly to switch on or switch off, so that the heating assembly operates under the preset power.

Herein, the electronic cigarette further includes a resistance detection circuit, the resistance detection circuit including a control end, an input end and an output end, the control end being coupled to the master control circuit, the input end being coupled to the power supply, the output end being coupled to a standard resistor and the heating assembly in sequence; the master control circuit further includes a voltage detection end, which is coupled to the standard resistor; wherein the master control circuit is configured for controlling the output power control circuit to switch off, and meanwhile controlling the resistance detection circuit to switch on a current path between the power supply and the standard resistor, so as to detect the voltage of the standard resistor through the voltage detection end and to calculate the effective resistance of the heating assembly according to a proportional relationship of voltage division and resistance between the standard resistor and the heating assembly.

Through the above technical scheme, the output voltage of the power supply of the electronic cigarette is acquired first, then a duty ratio meeting the preset power is calculated using the detected output voltage and the effective resistance of the heating assembly, and finally, the current circuit of the heating assembly of the electronic cigarette is driven to switch on or switch off according to the duty ratio, so that the heating assembly operates under the preset power. Thus, the cost of the electronic cigarette can be lowered, a relatively stable TPM value can be output, and the size of the electronic cigarette can be reduced.

DETAILED DESCRIPTION

The present disclosure is described below in detail in conjunction with the accompanying drawings and embodiments.

Figure 1:
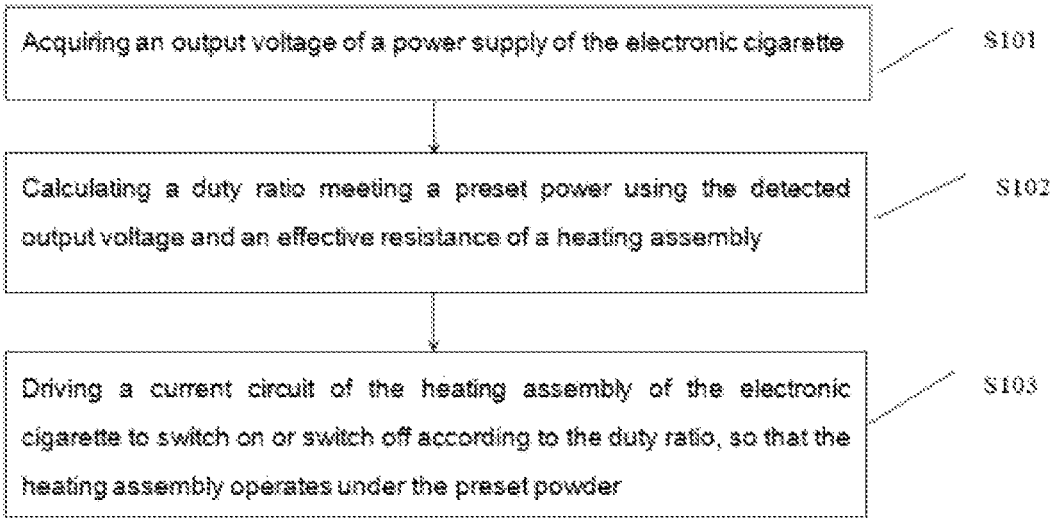
FIG. 1 is a flowchart of an embodiment of a driving method for an electronic cigarette according to the present disclosure.

Please refer to FIG. 1, which is a flowchart of an embodiment of a driving method for an electronic cigarette according to the present disclosure. It should be noted that the method of the present disclosure is not necessarily limited to the flow sequence indicated in FIG. 1 if there can be a substantially same result obtained. As shown in FIG. 1, the method includes the following steps.

S101: acquiring an output voltage of a power supply of the electronic cigarette.

Herein, the output voltage of the power supply of the electronic cigarette can be detected by an analog-digital converter arranged in a master control circuit.

S102: calculating a duty ratio meeting a preset power using the detected output voltage and an effective resistance of a heating assembly.

Herein, the duty ratio can be obtained using the following formula:

$$\text{Duty} = \frac{P \times R}{U \times U};$$

wherein Duty denotes the duty ratio, P denotes the preset power, R denotes the effective resistance, and U denotes the detected output voltage.

Specifically, the output voltage and the effective resistance of the heating assembly within one cycle are collected, and the duty ratio is adjusted continuously, so that an average power within one cycle is equal to the preset power.

Herein, collecting the effective resistance of the heating assembly within one cycle specifically includes: calculating the effective resistance of the heating assembly according to a proportional relationship of voltage division and resistance between a standard resistor and the heating assembly.

S103: driving a current circuit of the heating assembly of the electronic cigarette to switch on or switch off according to the duty ratio, so that the heating assembly operates under the preset power.

The duty ratio is essentially the proportion of the switch-on time of the current circuit of the heating assembly in one cycle. As the output voltage of the power supply changes continuously, the duty ratios within different cycles are adjusted continuously accordingly, so that the power is output meeting a substantially constant preset power.

Herein, in normal smoking, a master program calls two subprograms alternately in a cyclic manner, one subprogram collecting the effective resistance of the heating assembly within one cycle, and the other subprogram outputting the duty ratio so that the average power within one cycle is equal to the preset power. In the call process, it is needed to ensure that the time interval for each call is within one cycle. The time interval can be determined by load, battery cell capacity, multiplication factor, etc.

In the present embodiment, the output voltage of the power supply of the electronic cigarette is acquired first, then a duty ratio meeting the preset power is calculated using the detected output voltage and the effective resistance of the heating assembly, and finally, the current circuit of the heating assembly of the electronic cigarette is driven to switch on or switch off according to the duty ratio, so that the heating assembly operates under the preset power. Thus, the cost of the electronic cigarette can be lowered, a relatively stable TPM value can be output, and the size of the electronic cigarette can be reduced.

Figure 2:
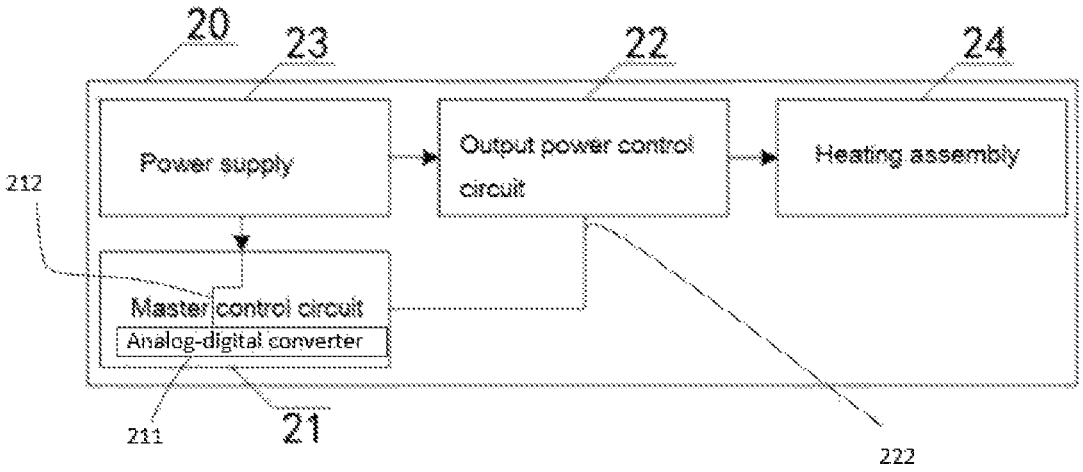
FIG. 2 is a structural diagram of an embodiment of a driving assembly for an electronic cigarette according to the present disclosure.

Referring to FIG. 2, the present disclosure provides an embodiment of a driving assembly for an electronic cigarette to illustrate the implementation of the above method. In the present embodiment, the driving assembly 20 refers to the driving assembly in the above embodiment. The driving assembly 20 includes a master control circuit 21, an output power control circuit 22, a power supply 23 and a heating assembly 24. The output power control circuit 22 has an input end coupled to the power supply 23, an output end coupled to the heating assembly 24, and a control end coupled to the master control circuit 21. The master control circuit 21 has an input end coupled to the power supply 23.

The master control circuit 21 has an analog-digital converter arranged therein, which is configured for detecting a voltage.

The analog-digital converter in the master control circuit 21 first receives a voltage signal fed back and converts the voltage signal into a digital signal, so as to realize detection of voltage value of the power supply 23, then the master control circuit 21 calculates a duty ratio meeting a preset power using the voltage value together with an effective resistance of the heating assembly 24, and outputs the calculated duty ratio to the output power control circuit 22. The output power control circuit 22 drives a current circuit of the heating assembly 24 to switch on or switch off according to the duty ratio, so that the heating assembly 24 operates under the constant preset power. Generally, the heating assembly 24 is connected to the power supply through a MOS transistor in the current circuit. The output power control circuit 22 can drive the MOS transistor to switch on or switch off according to the duty ratio, thereby adjusting the switch-on time of the MOS transistor, and allowing the heating assembly 24 to operate under the constant preset power within one cycle.

In particular, the master control circuit 21 is configured for completing functions of the entire machine, including human-computer interface processing, charge management, PWM constant power output control, atomizer impedance measurement, collection of output voltage, collection of quantity of electricity, short-circuit/low-voltage protection, etc.

The output power control circuit 22 is configured for calculating a duty ratio, through a constant power algorithm, using the impedance of the heating assembly 24 and the voltage value detected by the master control circuit 23, to drive the heating assembly 24.

The power supply 23 is configured for supplying power to the entire machine.

The heating assembly 24 is configured for heating and aerosolizing tobacco or liquid to generate an aerosol, thereby achieving an effect of puffing.

The PWM is an analog control mode, which modulates the bias of a base electrode of a transistor or a grid electrode of the MOS transistor according to the change of a corresponding load, so as to realize change of switch-on time of the transistor or MOS transistor, thereby realizing change of regulated supply output of the switch. The MOS transistor can be a Metal-Oxide-Semiconductor Field-Effect-Transistor.

The output power control circuit 22 is a PWM control circuit, a BUCK-BOOST circuit, a BUCK circuit or a BOOST circuit.

In the present embodiment, the master control circuit detects the output voltage of the power supply, calculates a duty ratio meeting the preset power using the detected output voltage and the effective resistance of the heating assembly, and outputs the duty ratio to the output power control circuit; thus, a relatively stable TPM value can be output, the cost of the electronic cigarette can be lowered, and the size of the electronic cigarette can be reduced.

Figure 3:
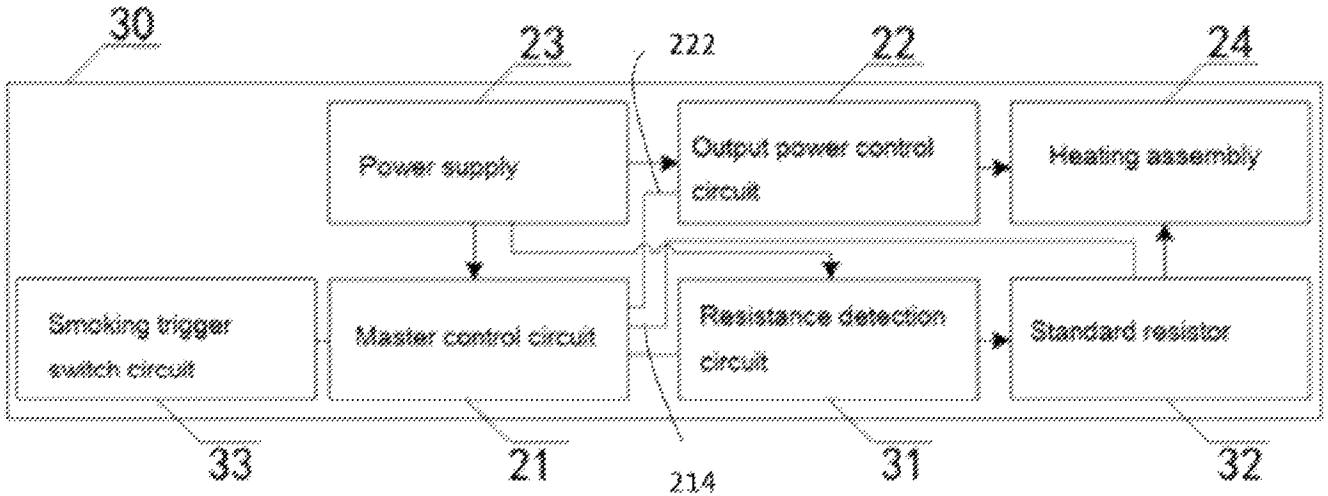
FIG. 3 is a structural diagram of another embodiment of a driving assembly for an electronic cigarette according to the present disclosure.

Referring to FIG. 3, the present disclosure provides another embodiment of a driving assembly for an electronic cigarette to illustrate the implementation of the above method. Different from the above embodiment, the driving assembly 30 in the present embodiment includes a resistance detection circuit 31, a standard resistor 32 and a smoking trigger switch circuit 33. The resistance detection circuit 31 has a control end coupled to the master control circuit 21, an input end coupled to the power supply 23, and an output end coupled in sequence to the standard resistor 32 and the heating assembly 24 that are in series connection. The smoking trigger switch circuit 33 is coupled to the master control circuit 21.

The master control circuit 21 further includes a voltage detection end, which is coupled to the standard resistor 32, that is to say, the voltage detection end of the master control circuit 21 leads to a detection wire connected to the output end of the standard resistor 32, so that voltages of two ends of the standard resistor 32 can be detected.

When in work, the master control circuit 21 first controls the output power control circuit 22 to switch off, and then controls the resistance detection circuit 21 to switch on the current paths between the power supply 23 and the standard resistor 32 and between the power supply 23 and heating assembly 24. The master control circuit 21 detects the voltage signal of the standard resistor 32 through the voltage detection end of the master control circuit 21, and converts the voltage signal into a voltage value of the standard resistor 32 through the analog-digital converter. The master control circuit 21 finally detects the effective resistance of the heating assembly 24 according to a proportional relationship of voltage division and resistance between the standard resistor 32 and the heating assembly 24. Since the standard resistor 24 and the heating assembly 24 are in series connection, the resistance value and the voltage value are in direct proportion between the standard resistor 32 and the heating assembly 24; accordingly, the effective resistance of the heating assembly 24 can be calculated. In the present embodiment, the impedance of the heating assembly 24 is relatively small, generally below 0.1 to 1.0 ohm. In the present embodiment, an indirect measurement manner adopting the standard resistor is employed. Comparing with a direct measurement manner, the indirect measurement manner can simplify the structure of the circuit, reduce the size of the electronic cigarette and reduce the cost.

Further, the duty ratio meeting the preset power is calculated using the following formula:

$$\text{Duty} = \frac{P \times R}{U \times U},$$

where Duty denotes the duty ratio, P denotes the preset power, R denotes the effective resistance, and U denotes the detected output voltage.

Further, after the smoking trigger switch circuit 33 is switched on, calculation and output actions of the duty ratio are triggered, so that functions such as aerosolization can be achieved.

Herein, the smoking trigger switch circuit 33 includes a button sensor or an airflow sensor.

Figure 4:
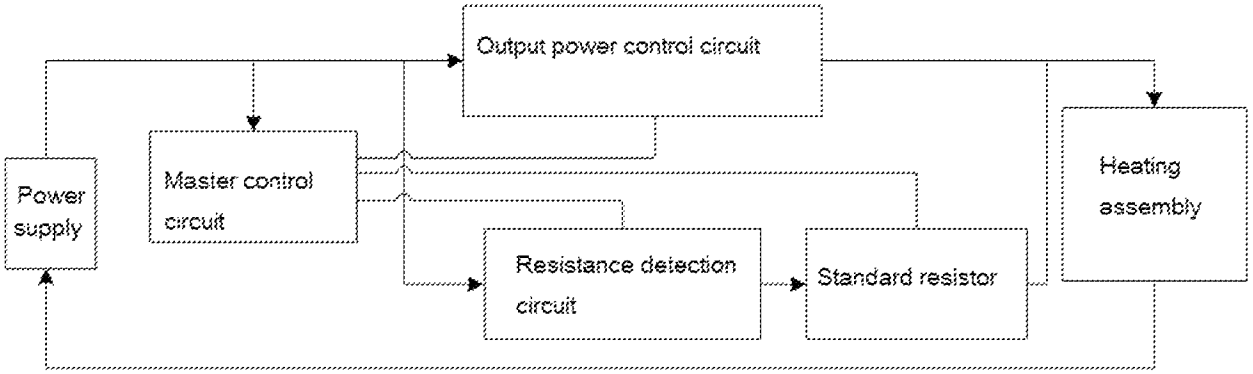
FIG. 4 is a schematic circuit diagram of a driving assembly for an electronic cigarette according to the present disclosure.

One application scenario illustrates a schematic circuit diagram of the driving assembly for the electronic cigarette, as shown in FIG. 4. In a subprogram detecting the resistance of the heating assembly 24, the master control circuit 21 outputs a control signal to switch off the output power control circuit 22 and immediately switch on the resistance detection circuit 31, thus allowing the voltage of the power supply 23 to be applied to the standard resistor 32 and the heating assembly 24; meanwhile, the master control circuit 21 collects a voltage ratio of the standard resistor 32 and the power supply 23, and then carries out software contrast, so as to determine the impedance of the heating assembly 24. In a subprogram outputting the duty ratio so that the average power within one cycle is equal to the preset power, the master control circuit 21 outputs a control signal to switch off the resistance detection circuit 31 and switch on the output power control circuit 22, and outputs a power to drive the heating assembly 24 to heat and aerosolize tobacco or liquid to generate an aerosol. It should be noted that the master program needs to call the two subprograms alternately in a cyclic manner when a user smokes normally. In the call process, it is needed to ensure that the time interval for each call is within one PWM cycle. The master control circuit 21 controls the resistance detection circuit 31 and the output power control circuit 22 to switch on alternately in a cyclic manner.

In the present embodiment, the effective resistance, the preset power and the output voltage of the atomization assembly/heating assembly of the electronic cigarette are detected through the resistance detection circuit, thus a duty ratio meeting the preset power can be calculated through a formula $$\text{Duty} = \frac{P \times R}{U \times U},$$

and then the duty ratio is output to the output power control circuit; therefore, a relatively stable TPM value can be output, the cost of the electronic cigarette can be lowered, and the size of the electronic cigarette can be reduced.

Figure 5:
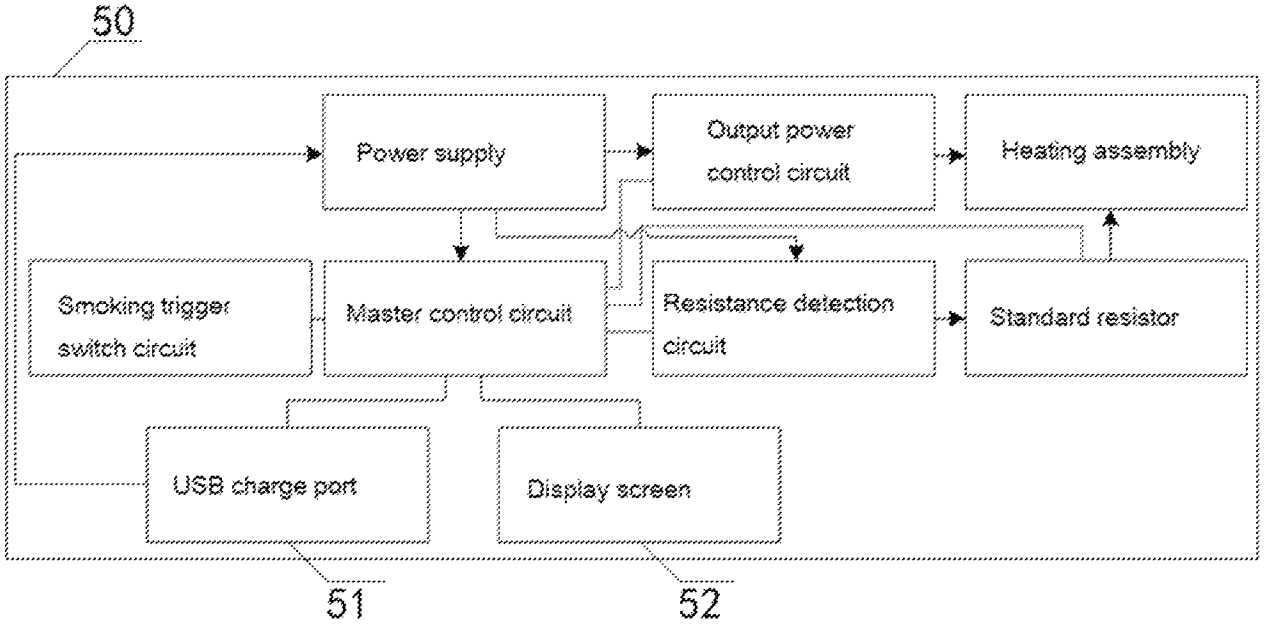
FIG. 5 is a structural diagram of an embodiment of an electronic cigarette according to the present disclosure.

Please refer to FIG. 5, which is a structural diagram of an embodiment of an electronic cigarette according to the present disclosure. Besides the driving assembly described in the above embodiment, the electronic cigarette 50 in the present embodiment includes further includes a USB charge port 51 and a display screen 52. The display screen 52 and the USB charge port 51 are both coupled to the master control circuit 21. The USB charge port 51 has an input end coupled to the power supply 23.

The display screen 52 can be a Light Emitting Diode (LED), also can be a Liquid Crystal Display (LCD), and is configured for displaying and setting main parameters or statuses, for example, alarm, charging status, and smoking status indicator.

The USB charge port 51 is used for a charging management IC and is configured for managing charging means such as pre-charge, constant current and constant voltage, thereby ensuring charging safety and efficiency.

In the present embodiment, through the charging management of the USB charge port and the parameter setting or status display of the display screen, not only the charging safety and efficiency of the electronic cigarette can be enhanced, but also the usage status of the electronic cigarette can be observed in real time; furthermore, a relatively stable TPM value can be output.

The above are embodiments of the present disclosure merely and are not intended to limit the patent scope of the present disclosure. Any equivalent structures or equivalent process transformations made according to the description and the accompanying drawings of the present disclosure, or any equivalent structures or equivalent flow modifications applied in other relevant technical fields directly or indirectly are intended to be included in the patent protection scope of the present disclosure.

What is claimed is:

1. A driving assembly for an electronic cigarette, the electronic cigarette comprising a heating assembly, the driving assembly being configured for driving the heating assembly to heat liquid or tobacco so as to generate an aerosol, the driving assembly comprising:

a master control circuit, the master control circuit comprising an analog-digital converter, the analog-digital converter comprising an input end coupled to a power supply; and an output power control circuit, the output power control circuit comprising an input end coupled to the power supply, an output end coupled to the heating assembly, and a control end coupled to the master control circuit;

wherein the master control circuit is configured for detecting an output voltage of the power supply, calculating a duty ratio meeting a preset power using the detected output voltage and an effective resistance of the heating assembly, and outputting the duty ratio to the output power control circuit; and the output power control circuit is configured for driving, according to the duty ratio, a current circuit of the heating assembly to switch on or switch off, so that the heating assembly operates under the preset power;

wherein the driving assembly further comprises:

a resistance detection circuit, the resistance detection circuit comprising a control end, an input end and an output end, the control end being coupled to the master control circuit, the input end being coupled to the power supply, the output end being coupled to a standard resistor and the heating assembly in sequence;

wherein the master control circuit further comprises a voltage detection end, which is coupled to the standard resistor;

wherein the master control circuit is configured for controlling the output power control circuit to switch off, and meanwhile controlling the resistance detection circuit to switch on a current path between the power supply and the standard resistor, so as to detect the voltage of the standard resistor through the voltage detection end and to calculate the effective resistance of the heating assembly according to a proportional relationship of voltage division and resistance between the standard resistor and the heating assembly.

2. The driving assembly for an electronic cigarette according to claim 1 further comprising: a smoking triggering switch circuit coupled to the master control circuit, wherein when the smoking triggering switch circuit is activated, calculation of the duty ratio and output actions of the duty ratio are triggered.

3. The driving assembly for an electronic cigarette according to claim 2, wherein the smoking triggering switch circuit comprises a button or airflow sensor.

4. The driving assembly for an electronic cigarette according to claim 1, further comprising:

a smoking triggering switch circuit coupled to the master control circuit, wherein when the smoking triggering switch circuit is activated, calculation of the duty ratio and output actions of the duty ratio are triggered.

5. The driving assembly for an electronic cigarette according to claim 4, wherein the smoking triggering switch circuit comprises a button or airflow sensor.

6. The driving assembly for an electronic cigarette according to claim 1, wherein a frequency of the calculation and output actions of the duty ratio is consistent with an output guise generated by the output power control circuit.

7. The driving assembly for an electronic cigarette according to claim 1, wherein the frequency of the calculation and output actions of the duty ratio is consistent with an output pulse generated by the output power control circuit.

8. The driving assembly for an electronic cigarette according to claim 1, wherein the output power control circuit is a PWM control circuit; a BUCK-BOOST circuit, a BUCK circuit or a BOOST circuit.

9. The driving assembly for an electronic cigarette according to claim 1, wherein the output power control circuit is a PWM control circuit, a BUCK-BOOST circuit, a BUCK circuit or a BOOST circuit.

10. An electronic cigarette, comprising the driving assembly according to claim 1.

* * * * *